US006346917B1

(12) United States Patent
Fuchs et al.

(10) Patent No.: US 6,346,917 B1
(45) Date of Patent: Feb. 12, 2002

(54) METHOD FOR IMPLEMENTING A VEHICULAR ANTENNA SYSTEM

(75) Inventors: Andreas D. Fuchs, Orion Township; Ronald A. Marino, Flushing; Clyde M. Callewaert, Shelby Township, all of MI (US)

(73) Assignee: RecepTec LLC, Holly, MI (US)

( * ) Notice: Subject to any disclaimer, the term of this patent is extended or adjusted under 35 U.S.C. 154(b) by 0 days.

(21) Appl. No.: 09/711,127

(22) Filed: Nov. 9, 2000

(51) Int. Cl.[7] ..... H01Q 1/32
(52) U.S. Cl. ..... 343/713; 343/906
(58) Field of Search ..... 343/711, 712, 343/713, 906

(56) References Cited

U.S. PATENT DOCUMENTS 5,959,581 A 9/1999 Fusinski ..... 343/700 MS
5,973,648 A 10/1999 Lindermeier et al. ..... 343/713
6,028,557 A 2/2000 Oka ..... 343/713
6,043,782 A 3/2000 Dishart et al. ..... 343/713

*Primary Examiner*—Tan Ho
(74) *Attorney, Agent, or Firm*—Ware, Fressola Van Der Sluys & Adolphson LLP

(57) ABSTRACT

A method for installing an antenna system having an antenna located exterior to a vehicle. The antenna system has at least one electrically conductive wire to be extended into interior of the vehicle for providing electrical connection to a receiver located in the interior. When the vehicle includes at least one window pane surrounded at least partially by a flexible seal adjacent a weather shield to a portal, the method comprises the steps of positioning the conductive wire in the flexible seal; leading the conductive wire from the flexible seal towards the weather shield; and leading the conductive wire to the receiver through the weather shield.

8 Claims, 2 Drawing Sheets

METHOD FOR IMPLEMENTING A VEHICULAR ANTENNA SYSTEM

FIELD OF THE INVENTION

The present invention relates generally to a method of implementing an antenna system on an automobile and, more particularly, to the antenna system with broadband operating characteristics for use in a Personal Communications Service (PCS) device operating in the frequency range of 1850–1900 MHz, Sirius Satellite Radio (2320–2332.5 MHz), XM Satellite Radio (2332.5–2345 MHz) and the like, wherein the antenna is mounted on the exterior of the automobile with transmission lines connected to a receiver in the interior of the automobile.

BACKGROUND OF THE INVENTION

Some antenna systems are added on to an automobile after the automobile has left the factory. With the antenna systems having broadband operating characteristics, the transmission lines are required to be routed from the exterior to the interior of the automobile so as to operatively connect the antenna to a receiver. The transmission lines typically take the form of a coaxial cable. Conventionally, the transmission lines for operatively connecting the antenna to the receiver are routed into the interior of automobile in two ways: through a drilled hole or through a glass coupler. Both of these methods have disadvantages. Drilling holes in the exterior body of the automobile may cause water leakage into the interior. Furthermore, due to warranty issues, many after-market installers are reluctant to drill holes in order to install the systems. Glass couplers can be used to couple RF signals from one side of a glass pane to the other side, so as to avoid drilling holes in the body of the automobile. However, when a DC power source is required for feeding an active antenna, such as that of a Sirius Satellite Radio, the DC power must be converted into AC and inductively coupled through the glass pane. The conversion of DC to AC has been found to produce harmonics that fall within the AM/FM band, thereby causing significant degradation to the performance of an existing AM/FM radio. Furthermore, RF coupling through the glass also introduces loss in the RF signals.

Thus, it is advantageous and desirable to provide a method for installing an antenna system having one or two transmission lines, wherein the transmission lines are routed from the exterior to the interior of the automobile, without additionally drilling holes to the exterior of the automobile body.

SUMMARY OF THE INVENTION

It is a primary object of the present invention to provide a method for installing an antenna system having an antenna located exterior to a vehicle having at least one electrically conductive wire to be extended into the interior of the vehicle for providing an electrical connection to a receiver located in the interior, without modifying the vehicular body by drilling holes or making other forms of apertures. When the vehicle includes at least one windowpane surrounded at least partially by a flexible seal adjacent a weather shield to a portal, the above-mentioned object can be achieved by a method which comprises the steps of:

positioning the conductive wire in the flexible seal;

leading the conductive wire from the flexible seal towards the weather shield; and leading the conductive wire to the receiver through the weather shield.

Preferably, the windowpane is a rear window glass pane of the vehicle and the flexible seal is a butyl rubber seal, which keeps the glass pane waterproof.

Preferably, the portal is the trunk of the vehicle, and the weather shield also includes a flexible seal surrounding at least part of the trunk opening of the vehicle.

The present invention will become apparent upon reading the description taken in conjunction with FIGS. 1–4.

BEST MODE FOR CARRYING OUT THE INVENTION

Figure 1:
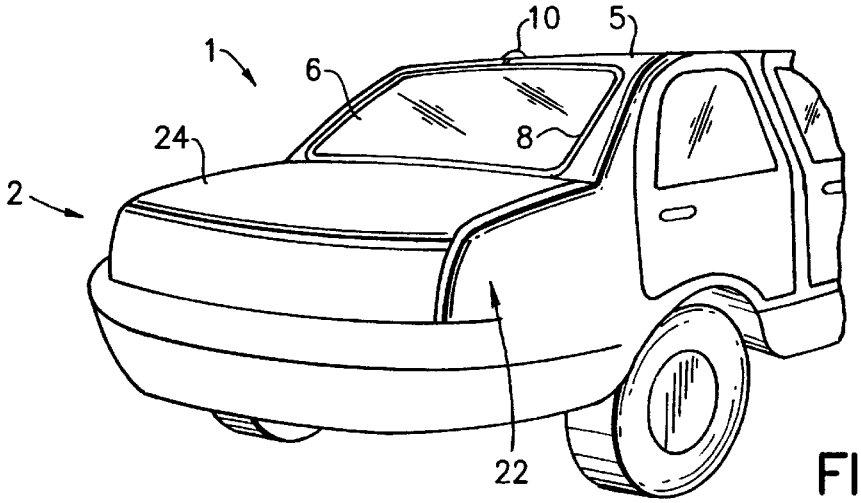
FIG. 1 is a perspective view illustrating the rear section of an automobile.

FIG. 1 shows the rear section 2 of a vehicle 1 having a rear window glass pane 6. The rear windowpane 6 is surrounded by a flexible seal 8 for weatherproofing. The flexible seal 8 is typically made of butyl rubber or other flexible polymer. As shown, an antenna 10 is installed on the roof section 5 of the automobile 1 above the rear windowpane 6. The vehicle 1 also includes a trunk 22 having a trunk lid 24.

Figure 2:
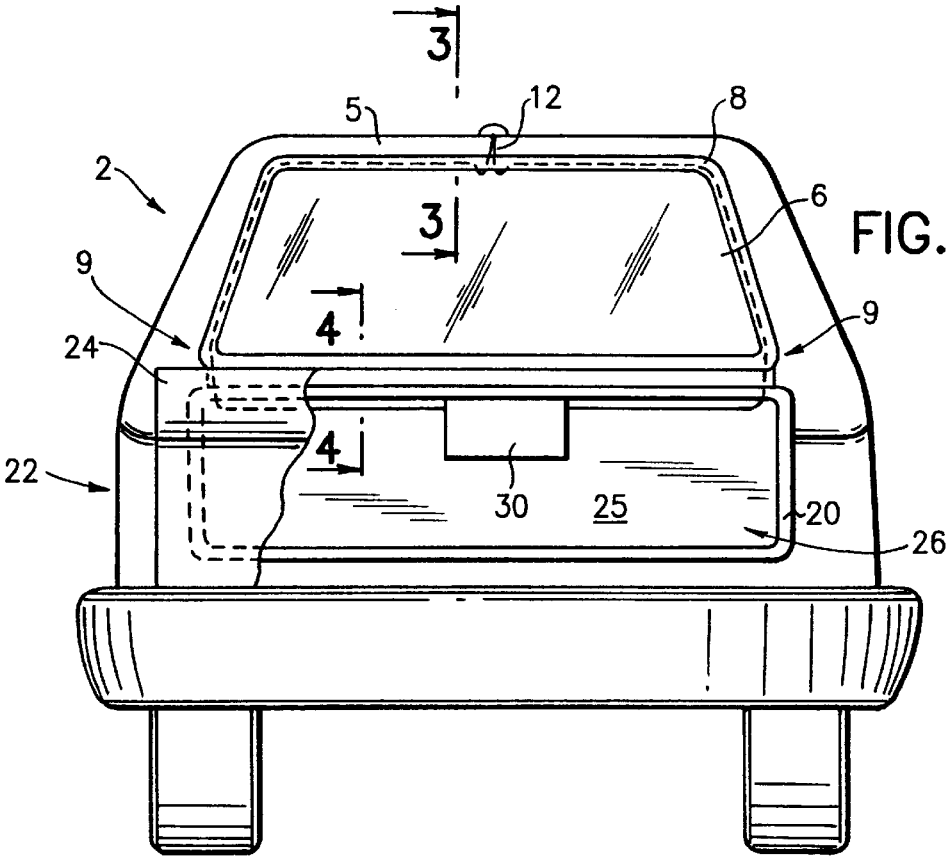
FIG. 2 is a rear view illustrating the rear window of the automobile and the location of the antenna system.

As shown in FIG. 2, the antenna 10 is connected to a receiver 30 by two electrically conductive wires 12. Each of the electrically conductive wires 12 can be a coaxial cable or a cable of another form, and one of the conductive wires 12 may be used to provide DC power to the antenna 10. The trunk 22 has a weather shield 20 surrounding the trunk opening 25 to keep water from leaking into the trunk compartment 26, when the trunk lid 24 is in the closed position. The antenna 10 is installed adjacent to the flexible seal 8 so that the conductive wires 12 can be routed along the flexible seal 8 to the lower section 9 of the flexible seal 8 in a substantially hidden fashion, as shown in FIG. 3.

Figure 3:
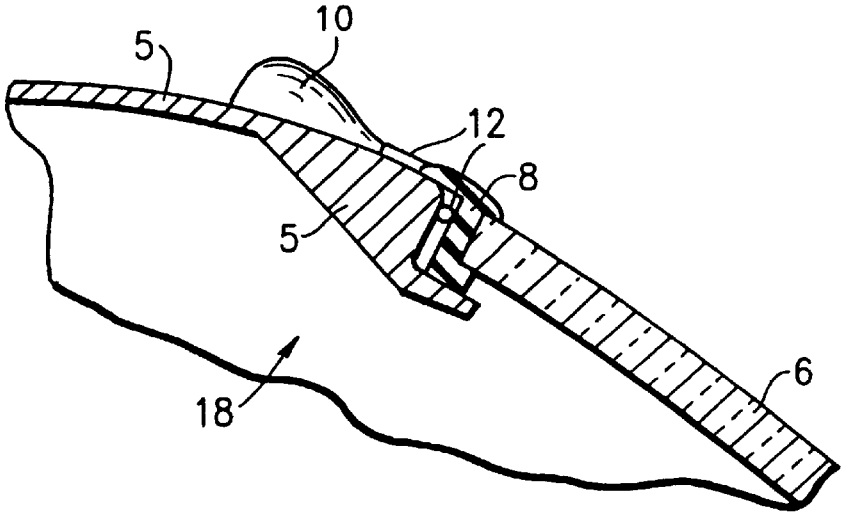
FIG. 3 is a cross sectional view illustrating the transmission lines of the antenna, which are routed inside the flexible seal of the rear windowpane.

FIG. 3 is a cross sectional view showing the flexible seal 8 having an outer section 14 and an inner section 16 facing the passenger compartment 18 of the automobile 1. Preferably, the conductive wires 12 are hidden under the outer section 14 of the flexible seal 8 all the way to the lower section 9 (FIG. 2).

Figure 4:
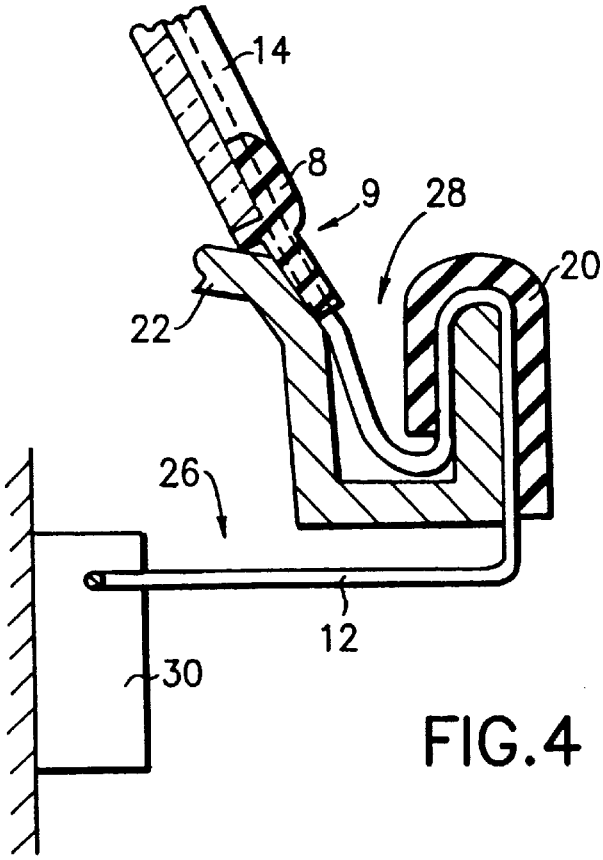
FIG. 4 is a cross sectional view illustrating the transmission lines of the antenna, which are routed from the flexible seal through a weather shield of the trunk opening to a receiver in the trunk compartment.

Typically, where the peripheral of the trunk lid 24 meets the trunk section 22, a trough-like structure 28, as shown in FIG. 4, is provided so as to allow water flowing through the gap between the trunk lid 24 and the rear body of the automobile to drain away. It is possible to lead the conductive wires 12 from the flexible seal 8 through a section of the weather shield 20 into the trunk compartment 26 so that the conductive wires 12 can be connected to the receiver 30.

It should be noted that the receiver 30, as illustrated in FIGS. 2 and 4, is located in the trunk compartment 26 of the automobile 1. However, it is also possible to place the receiver 30 in another part of the automobile 1 while the connection of the conductive wires 12 is made through the trunk section 22. For example, the receiver can be located in the passenger compartment 18. It is also possible to route the electrically conductive wires 12 through another flexible seal and weather shield. For example, the conductive wires 12 can be introduced into the interior of the automobile 1 through the front hood of the automobile 1. Furthermore, the conductive wires 12 can be routed along a flexible seal of some window-like panel, which may not be transparent. Moreover, the antenna can be directly installed near the weather shield 20 so that the conductive wires can be directly routed from the antenna 10 to the trunk compartment 26 of the automobile 1 through the weather shield 20, without using the flexible shield 8.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A method of installing a vehicular antenna system having an antenna located exterior to a vehicle, said antenna having at least one electrically conductive wire to be extended into an interior section of the vehicle for electrically connecting the antenna to a receiver located in the interior section, wherein the vehicle includes a weather shield bordering the interior section and the exterior of the vehicle, at least one panel on the exterior of the vehicle adjacent to the weather shield, and a flexible seal at least partially surrounding the panel, said method comprising the steps of:

leading said at least one electrically conductive wire from the antenna towards the weather shield;

leading said at least one electrically conductive wire to the receiver through the weather shield; and positioning said at least one electrically conductive wire along at least one section of the flexible seal prior to leading the electrically conductive wire towards the weather shield.

2. The method of claim 1, wherein the panel includes a rear window glass pane of the vehicle.

3. The method of claim 1, wherein the flexible seal includes a butyl rubber seal.

4. The method of claim 1, wherein the vehicle has a trunk and the weather shield is located adjacent to the trunk for shielding at least part of the trunk, and the electrically conductive wire is led to the receiver through the weather shield and the trunk.

5. The method of claim 1, wherein said antenna has two electrically conductive wires.

6. The method of claim 5, wherein the vehicle has a trunk and the weather shield is located adjacent to the trunk for shielding at least part of the trunk, and the two electrically conductive wires are led to the receiver through the weather shield and the trunk.

7. The method of claim 5, wherein one of the two electrically conductive wires is used for providing electrical power to said antenna.

8. The method of claim 1, wherein said at least one electrically conductive wire is a coaxial cable.

* * * * *